US005913946A

United States Patent [19]

Ewing

[11] Patent Number: 5,913,946

[45] Date of Patent: Jun. 22, 1999

[54] ADJUSTABLE ACCELERATOR PEDAL APPARATUS

[75] Inventor: Kip Alan Ewing, Dearborn, Mich.

[73] Assignee: Ford Global Technologies, Inc., Dearborn, Mich.

[21] Appl. No.: 08/969,962

[22] Filed: Nov. 25, 1997

[51] Int. Cl.[6] ..... G05G 1/14

[52] U.S. Cl. ..... 74/513; 74/512; 74/501.5 R; 74/500.5; 74/560; 74/474; 74/478

[58] Field of Search ..... 74/512, 560, 513, 74/514, 474, 478, 530, 500.5, 501.5 R; 192/111 A

[56] References Cited

U.S. PATENT DOCUMENTS

| | | | |
|---|---|---|---|
| 3,039,322 | 6/1962 | Powrie . | |
| 3,151,499 | 10/1964 | Roe . | |
| 3,242,763 | 3/1966 | Buchwald . | |
| 3,282,125 | 11/1966 | Dully . | |
| 3,400,607 | 9/1968 | Smith . | |
| 3,541,881 | 11/1970 | Pharis . | |
| 3,563,111 | 2/1971 | Zeigler . | |
| 3,691,868 | 9/1972 | Smith . | |
| 3,828,625 | 8/1974 | Bruhn | 74/560 X |
| 3,975,972 | 8/1976 | Muhleck . | |
| 4,010,657 | 3/1977 | Amdall | 74/513 X |
| 4,067,426 | 1/1978 | Murphy | 74/512 X |
| 4,497,399 | 2/1985 | Kopich | 192/111 A |
| 4,875,385 | 10/1989 | Sitrin . | |
| 5,172,606 | 12/1992 | Dzioba et al. . | |
| 5,351,573 | 10/1994 | Cicotte . | |
| 5,588,335 | 12/1996 | Strait | 74/575 X |
| 5,611,249 | 3/1997 | Perisho et al. | 74/501.5 R X |
| 5,794,492 | 8/1998 | Pare | 74/529 |
| 5,855,143 | 1/1999 | Ewing | 74/512 |

FOREIGN PATENT DOCUMENTS

| | | | |
|---|---|---|---|
| 1198685 | 8/1965 | Germany | 74/512 |
| 2-122316 | 5/1990 | Japan | 74/512 |

*Primary Examiner*—Vinh T. Luong
*Attorney, Agent, or Firm*—Gregory P. Brown

[57] ABSTRACT

An adjustable accelerator pedal apparatus allows the adjustment of a first end of a pedal lever (18) to accommodate operators having varying anatomical characteristics. The apparatus includes a an adjuster link (32) having a first end pivotally connected to a second point (33) on a rocker (28) a first end pivotally connected to a first ground point (36). An anchor link (44) is pivotally connected to a second ground point (46) at one end and a third point (50) of the rocker (28) at the opposite end. A cable (60) interconnects the pedal lever to the throttle linkage 66, thereby allowing actuation of the throttle (68) upon displacement of the pedal. The interconnection of the adjuster link and a second point (33) on the rocker form a virtual ground point (70) allowing the first end of the pedal lever (18) to be adjusted between first and second pedal positions.

7 Claims, 3 Drawing Sheets

ADJUSTABLE ACCELERATOR PEDAL APPARATUS

BACKGROUND OF THE INVENTION

1. Field of the Invention

The present invention relates generally to control devices for motor vehicles. More particularly the apparatus is useful for providing an adjustable accelerator pedal position to accommodate various vehicle operators.

2. Disclosure Information

In the conventional motor vehicle, pedals are provided for controlling the brakes and engine throttle. If the vehicle has a manual transmission, then a clutch pedal may also be provided. These pedal controls are operated by the vehicle operator. In order for the vehicle operator to obtain the most advantageous position for working these controls, the vehicle's front seat is usually slidably mounted on a seat track with means for retaining the seat along the track in a number of set positions.

The adjustment provided by moving the seat along the seat track does not accommodate all vehicle operators due to obvious differences in anatomical dimensions. It has therefore been recognized that it would be desirable to provide pedals that are adjustable so as to increase the comfort of the vehicle operator. For instance, U.S. Pat. No. 3,400,607, assigned to the same Assignee as the present invention, provides a vehicle control assembly for providing pedal adjustments. Previous adjustable pedal assemblies shared common shortcomings preventing their wide commercial success. Generally the designs were costly, very complex to manufacture and assemble and inconsistent in function throughout their range of adjustment. Specifically, the function attributes include providing a constant motion ratio through the full range of pedal adjustment, which is desirable for maintaining the desired actuation efforts. Additionally, previous adjustable pedal assemblies did not provide consistent ergonomic pedal travel throughout the range of adjustment.

It would be desirable to overcome the aforenoted difficulties with previous adjustable pedal assemblies for use in motor vehicles by providing a simple, low cost apparatus for adjusting the pedal location and providing all operators of various anatomical dimensions preferred pedal efforts and ergonomic pedal travel for operation of the motor vehicle.

SUMMARY OF THE INVENTION

Therefore, the present invention provides an improvement over conventional vehicles by providing an adjustable accelerator pedal control that is moveably mounted so that the operator may select an appropriate spacing between the seat and the pedals commensurate with the length of the operators legs.

In accordance with the present invention, an adjustable accelerator pedal apparatus for actuating a cable attached to a device within a vehicle includes a pedal lever having a first end and a rocker having a first point pivotally connected to a second end of the pedal lever. An adjuster link is pivotally connected to a second point of the rocker at its first end. A second end of the adjuster link is pivotally connected to a first ground point. The assembly also includes an anchor link having a first end pivotally connected to a second ground point and a second end pivotally connected to a third point on the rocker.

A flexible cable housing includes a first end that is attached to a fourth point on the rocker and a second end that is attached to the dash panel. A cable, connected at its first end to the pedal lever between the first and second ends of the pedal lever, is slidably disposed within the cable housing with its second end attached to a device for actuation upon application of an input force and displacement at the first end of the pedal lever by an operator.

Together, first end of the adjuster link and the second point of the rocker form a virtual ground point. Adjustment of the adjuster link relative to the first ground point between a first position and a second position adjusts the first end of the pedal lever between corresponding first and second pedal positions.

It is an advantage of the present invention to provide a simple, low cost adjustable accelerator pedal apparatus capable of providing, throughout its range of adjustment, consistent pedal efforts and ergonomic pedal travel for operation of the motor vehicle.

DETAILED DESCRIPTION OF THE PREFERRED EMBODIMENT

Figure 1:
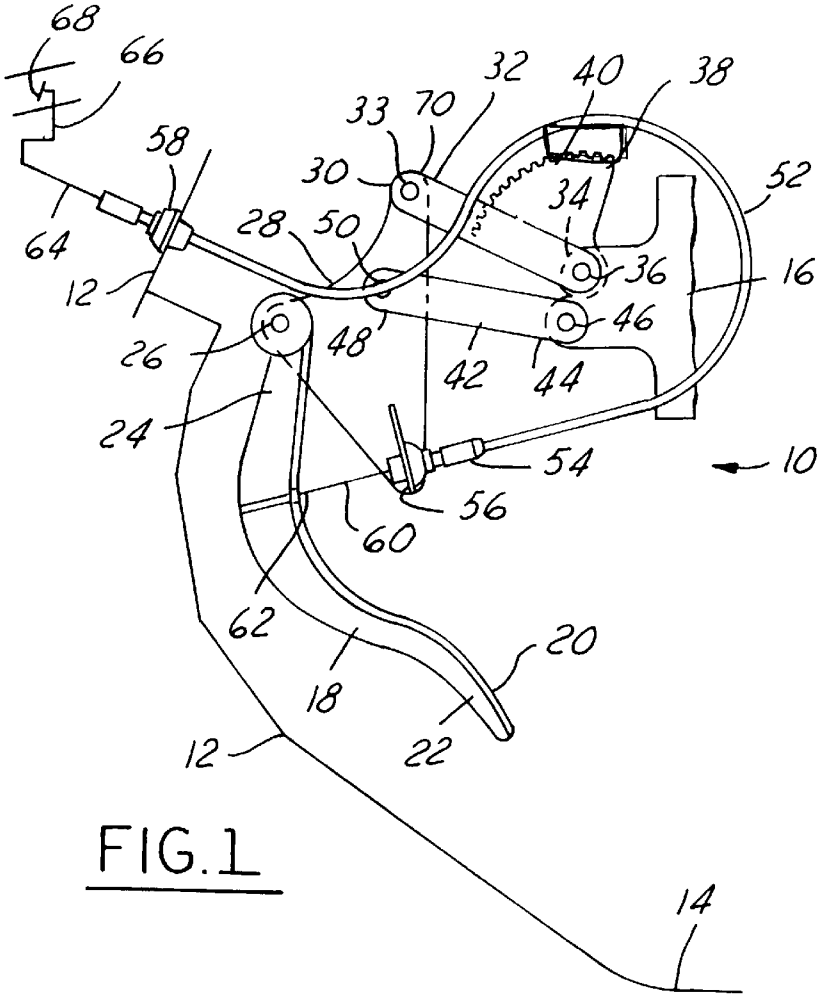
FIG. 1 is a side elevational view of an adjustable pedal mechanism for a motor vehicle constructed in accordance with the present invention.

Referring now to FIG. 1, the adjustable accelerator pedal assembly 10 is shown installed in a motor vehicle. The vehicle includes a dash panel 12, which extends downward to a portion of a floor member 14, and a pedal support structure 16, which may be constructed from crossbars integrated with an instrument panel and steering column support structure.

A pedal lever 18 includes a pad 20 at its first end 22 and a second end 24 that is pivotally connected a first point 26 of a rocker 28. A first end 30 of an adjuster link 32 is pivotally connected to a second point 33 of the rocker and a second end 34 is pivotally connected to a first ground point 36 which depends from the stationary pedal support structure 16.

An adjust mechanism, illustrated here by a sector gear 38, drivingly engaged with an electric motor driven worm gear 40, provides for infinitely adjusting the position of the adjuster link 32 relative to the first ground point 36 between two positions defined by the ends of the sector gear. In the illustrated embodiment, the gear ratio of the sector gear and the worm gear are sufficient to prevent unintended movement of the sector gear during operation of the pedal. It should be recognized by those skilled in the art that the adjuster mechanism may comprise one of many known devices, including driving the worm gear via a remote motor and cable, or with a manual mechanism providing the displacement of a cable through actuation of a lever or knob.

An anchor link 42 includes a first end 44 pivotally connected to a second ground point 46 which depends from the stationary pedal support structure 16. A second end 48 of the anchor link 42 is pivotally connected to a third point 50 of a rocker 28. A flexible cable housing 52 has a first end 54 attached to a fourth point 56 on the rocker 28. The fourth point 56, together with the first and second points of the rocker form the three vertices of a triangular shaped rocker.

The cable housing 52 forms a large partial loop between its first end 54 and its second end 58, which is attached to the dash panel 12. This permits slack for adjustment of the pedal mechanism without binding the movement of internal cable 60. A first end 62 of the cable 60 is connected to the pedal lever 18 between the first and second ends 22, 24 and the second end 64 of the cable 60 attaches to a throttle linkage 66 for actuation of a throttle 68.

For any adjusted position of the adjuster link 32, a unique virtual ground point 70 is formed by the connection of the first end 30 of the adjuster link 32, and the second point 33 of the rocker 28. Adjustment of the adjuster link 32 relative to the first ground point 36 between a first position and a second position adjusts the location of the virtual ground point 70 and adjusts the location of the first end of the pedal lever between corresponding first and second positions.

Operation of the adjustable accelerator pedal will now be described. FIG. 1 illustrates the pedal assembly in an released position, that is, with no input force being applied by an operator. Further, the pedal is adjusted to its first or forward most position, to accommodate operators having longer legs, thus requiring greater space between a seat and the pedal assembly. The pedals may also be put in this position to facilitate ingress and egress of the operator.

Figure 2:
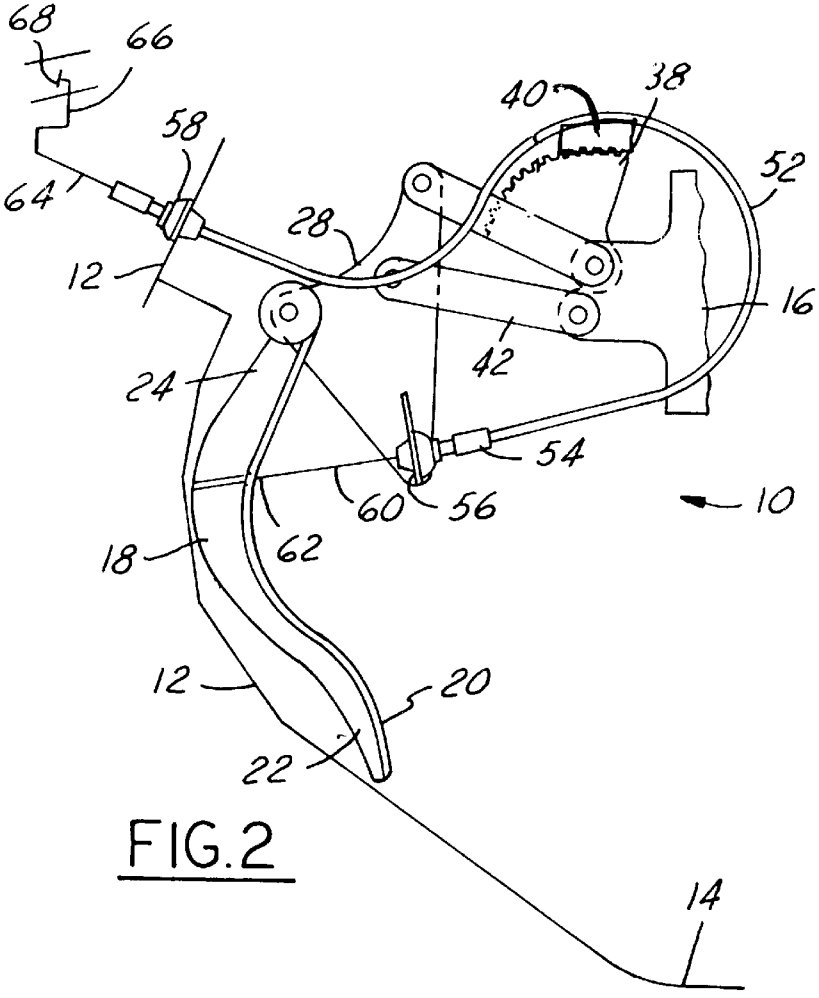
FIG. 2 is a side elevational view of an adjustable pedal mechanism for a motor vehicle constructed in accordance with the present invention.

FIG. 2 illustrates the pedal subjected to an input force and having been full displaced. The adjuster link 32, the virtual ground point 70 do not move during operation of the pedal. As the pedal is pressed toward the floor by the operator, the pedal lever 18 pivots about the first point 26 on the rocker 28. The rocker 28 is prevented from rotating by the virtual ground point 70 and the anchor link 44. Therefore, an output displacement and force results from the cable 60 being drawn out of the cable housing 52, thus actuating or opening the throttle 68.

Figure 5:
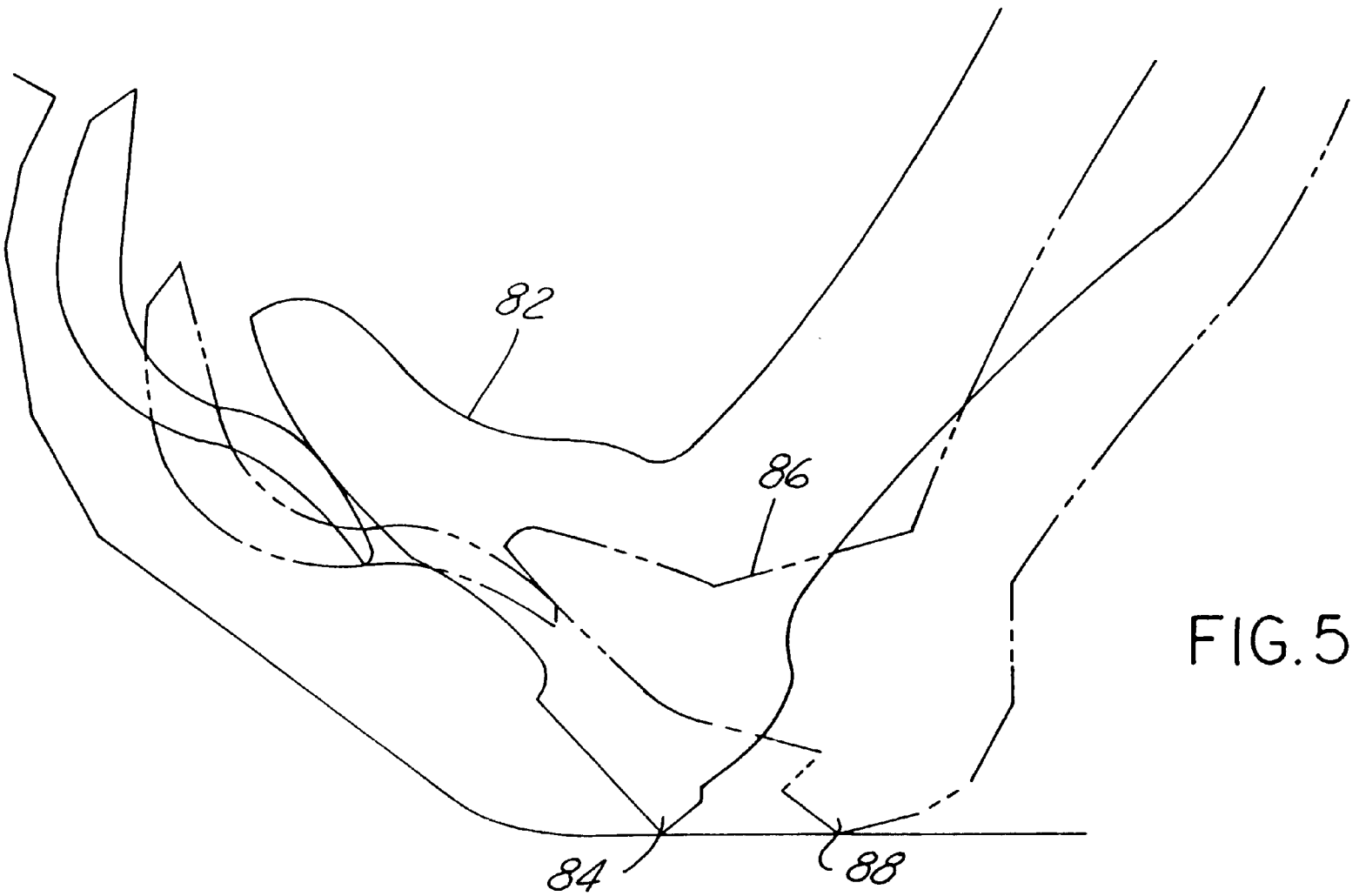
FIG. 5 is a side elevational view showing a ninety-fifth percentile operator's foot relative to a correspondingly adjusted pedal and a two and a half percentile operator's foot relative to a correspondingly adjusted pedal as provided by the by the present invention.

Referring now to FIG. 5, operation of the pedal lever 18 from the first position to the second position is represented by the large foot outline 82. It can be seen that the heel 84 of the operator's foot rests on a portion of the floor member 14. It is well known that to prevent fatigue and discomfort, it is important to allow the operator's heel 84 to rest on the floor member 14 while maintaining contact with the pad 20 of the brake lever. Additionally, the operator should be able to press the pedal through its travel without lifting the heel from the floor member.

Referring now to the smaller foot 86, it should be apparent that for this operator to apply the pedal with it in the forward most position (shown as A) the operator would either have to lift the small heel 88 from the floor, or move the seat considerably forward. Moving the seat forward is undesirable for a variety of reasons, including the sharper angles that the operators leg and foot must form to operate the pedal. For these reasons and others, the present invention permits the operator to adjust the pedal lever rearward in such a manner that an operator with shorter legs can maintain heel contact while pressing the pedal lever through its range of motion.

Figure 4:
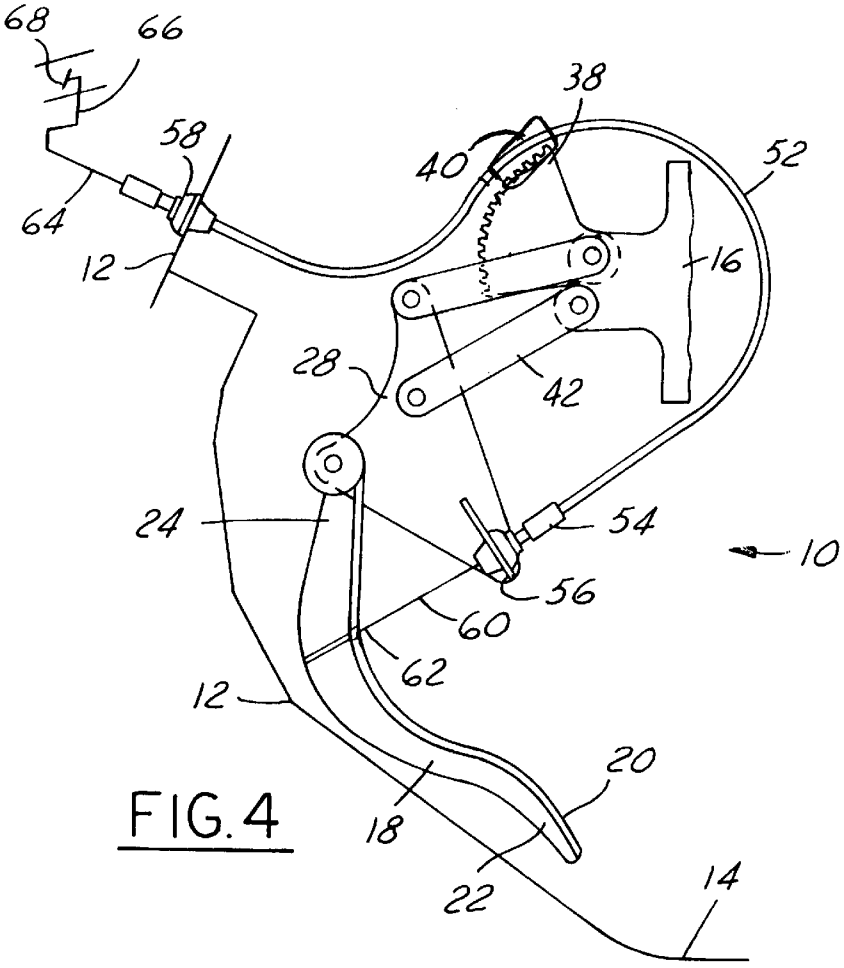
FIG. 4 is a side elevational view of an adjustable pedal mechanism for a motor vehicle constructed in accordance with the present invention.
Figure 3:
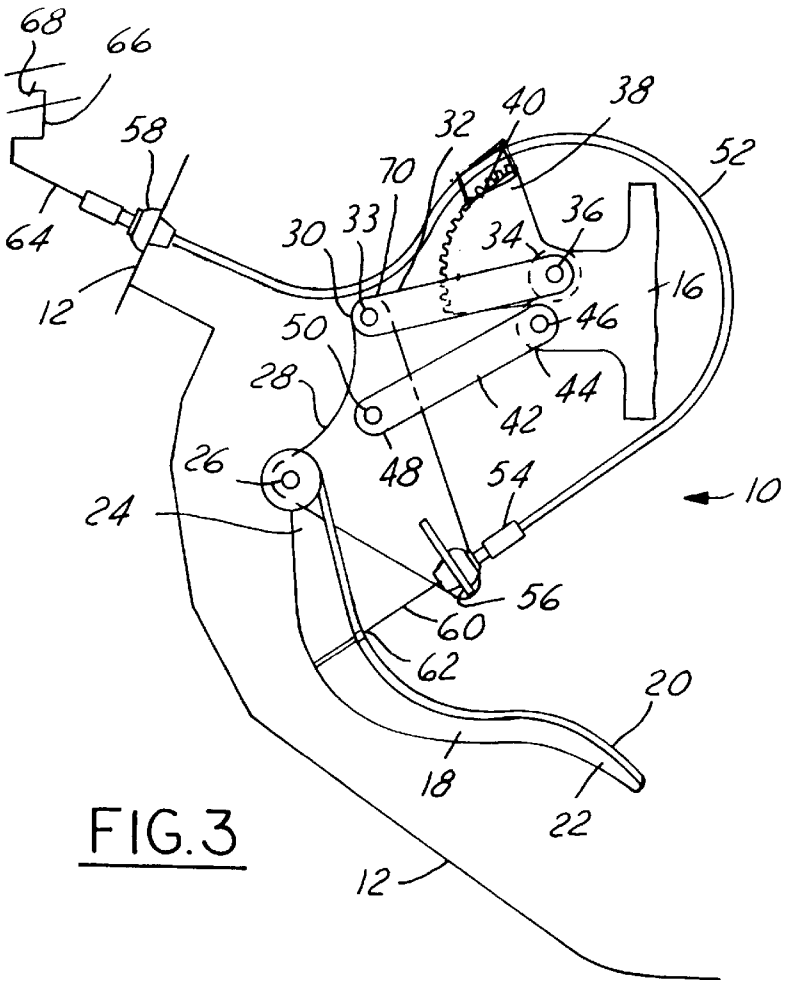
FIG. 3 is a side elevational view of an adjustable pedal mechanism for a motor vehicle constructed in accordance with the present invention.

FIGS. 3 and 4 illustrate the adjustable pedal assembly adjusted to its second or rearward position in the released and applied positions, respectively. The adjustment is accomplished by manipulating the sector gear 38 so as to rotate the adjuster link 32 downward about the first ground point 36. This drives the virtual ground point 70 downward, which repositions the rocker 28.

Various modifications and variations will no doubt occur to those skilled in the art to which this invention pertains. For instance, the second cable end 64 could be attached to a variety of other devices, such as a transducer mounted inside the vehicle for use with an electronic throttle. Those and all other variations which basically rely on the teachings by which this disclosure has advanced the art are properly considered within the scope of this invention as defined by the appended claims.

I claim:

1. An adjustable pedal apparatus for actuating a cable attached to a device within a vehicle, said adjustable pedal apparatus comprising:

a pedal lever having a first end;

a rocker having a first point pivotally connected to a second end of said pedal lever;

an adjuster link having a first end pivotally connected to a second point of said rocker and a second end pivotally connected to a first ground point;

an anchor link having a first end pivotally connected to a second ground point and a second end pivotally connected to a third point on said rocker;

a flexible cable housing having a first end attached to a fourth point on said rocker and a second end attached to a dash panel; and said cable connected to said pedal lever between said first end and said second end of said pedal lever and slidably disposed through said cable housing with a second end attached to the device for actuation;

wherein said first end of said adjuster link and said second point of said rocker form a virtual ground point, such that adjustment of said adjuster link relative to said first ground point between a first position and a second position adjusts said first end of said pedal lever between corresponding first and second pedal positions.

2. An adjustable pedal apparatus according to claim 1, further comprising adjuster means connected to said adjuster link for rotating said adjuster link relative to said first ground point between a first position and a second position and thereafter preventing further rotation of said adjuster link.

3. An adjustable pedal apparatus according to claim 2, wherein said adjuster means comprises a sector gear attached to said adjuster link adjacent to said first end of said adjuster link and a worm gear for meshingly engaging said sector gear.

4. An adjustable accelerator pedal apparatus for actuating a throttle within a vehicle, said adjustable accelerator pedal apparatus comprising:

a pedal lever having a pad disposed on a first end;

a rocker having a first point pivotally connected to a second end of said pedal lever;

an adjuster link having a first end pivotally connected to a second point of said rocker and a second end pivotally connected to a first ground point;

adjuster means for rotating said adjuster link relative to said first ground point between a first position and a second position;

an anchor link having a first end pivotally connected to a second ground point and a second end pivotally connected to a third point on said rocker;

a flexible cable housing having a first end attached to a fourth point on said rocker and a second end attached to a dash panel; and a cable connected to said pedal lever between said first end and said second end of said pedal lever and slidably disposed through said cable housing with a second end attached to said throttle;

wherein said first end of said adjuster link and said second point of said rocker form a virtual ground point, such that adjustment of said adjuster link relative to said first ground point between said first position and said second position adjusts said first end of said pedal lever between corresponding first and second pedal positions.

5. An adjustable accelerator pedal apparatus according to claim 4, wherein said adjuster means comprises a sector gear attached to said adjuster link adjacent to said first end of said adjuster link and a form gear for meshingly engaging said sector gear.

6. An adjustable accelerator pedal apparatus according to claim 4, wherein said rocker forms a triangular member having said first, second and fourth points as vertices.

7. An adjustable accelerator pedal apparatus for actuating a throttle within a vehicle, said adjustable pedal apparatus comprising:

a pedal lever having a pad disposed on a first end;

a rocker having a first point pivotally connected to a second end of said pedal lever;

an adjuster link having a first end pivotally connected to a second point of said rocker and a second end pivotally connected to a first ground point;

adjuster means for rotating said adjuster link relative to said first ground point between a first position and a second position;

an anchor link having a first end pivotally connected to a second ground point and a second end pivotally connected to a third point on said rocker;

a flexible cable housing having a first end attached to a fourth point on said rocker and a second end attached to a dash panel;

rocker forming a triangular member having said first, second and fourth points as vertices; and a cable connected to said pedal lever between said first end and said second end of said pedal lever and slidably disposed through said cable housing with a second end attached to said throttle such that said cable applies an output displacement and force to said throttle in response to an input displacement and force applied to said first end of said pedal lever.

* * * * *